US008056947B2

(12) United States Patent
Davidson

(10) Patent No.: US 8,056,947 B2
(45) Date of Patent: Nov. 15, 2011

(54) SPRING-LOADED ROD HANDLING DEVICE

(75) Inventor: Zales David Davidson, Choteau, MT (US)

(73) Assignee: Longyear TM, Inc., South Jordan, UT (US)

( * ) Notice: Subject to any disclaimer, the term of this patent is extended or adjusted under 35 U.S.C. 154(b) by 307 days.

(21) Appl. No.: 12/477,027

(22) Filed: Jun. 2, 2009

(65) Prior Publication Data

US 2009/0297326 A1 Dec. 3, 2009

Related U.S. Application Data

(60) Provisional application No. 61/058,518, filed on Jun. 3, 2008.

(51) Int. Cl.
*B65G 7/12* (2006.01)

(52) U.S. Cl. ..... 294/16; 294/106

(58) Field of Classification Search ..... 294/11, 294/16, 28, 106, 117
See application file for complete search history.

(56) References Cited

U.S. PATENT DOCUMENTS

| | | | | |
|---|---|---|---|---|
| 877,012 | A | 12/1905 | Sullivan | |
| 1,718,072 | A | 6/1929 | Quarnstrom | |
| 1,732,625 | A | 10/1929 | Wilson | |
| 2,132,781 | A | 10/1938 | Deckard | |
| 2,153,474 | A | 4/1939 | Naylor et al. | |
| 2,173,355 | A | 9/1939 | Criswell | |
| 2,495,834 | A | 1/1950 | Colquitt | |
| 2,551,636 | A | 5/1951 | Ratigan | |
| 2,789,001 | A * | 4/1957 | Sada Yonaki | 294/16 |
| 2,819,111 | A * | 1/1958 | Cozzens | 294/26 |
| 2,873,995 | A | 2/1959 | Turner | |
| 2,915,333 | A * | 12/1959 | Koenig et al. | 294/104 |
| 3,736,018 | A * | 5/1973 | Sayre et al. | 294/198 |
| 4,072,369 | A * | 2/1978 | Segreto | 175/325.7 |
| 4,268,082 | A | 5/1981 | Hooton | |
| 4,304,433 | A | 12/1981 | Langowski | |
| 4,324,157 | A | 4/1982 | Soutsos | |
| 4,470,177 | A | 9/1984 | Ganung et al. | |
| 4,705,121 | A | 11/1987 | Ancelle | |
| 4,754,996 | A | 7/1988 | Tecca et al. | |
| 4,796,936 | A | 1/1989 | Sherin | |
| 4,893,860 | A | 1/1990 | Kurbanov et al. | |

(Continued)

FOREIGN PATENT DOCUMENTS

EP 1552906 A2 7/2005

OTHER PUBLICATIONS

Parma, F. George, Robot Hand Grips Cylinders Securely: Jaws and linkage accommodates various sizes (NTIS Tech Note) National Aeronautics and Space Administration, Washington D.C. Dec. 1989, 1 page. [retrieved online] Jun. 3, 2009, Internet http://naca.larc.nasa.gov/details.jsp?R=439849.

(Continued)

*Primary Examiner* — Dean Kramer
(74) *Attorney, Agent, or Firm* — Workman Nydegger

(57) ABSTRACT

A rod handling device includes a pivot rod, first clamp assembly pivotingly coupled to the pivot rod, a second clamp assembly pivotingly coupled to the pivot rod, and at least one locking assembly configured to move between a locked position and an unlocked position. While in the locked position the locking assembly prevents rotation between the first clamp assembly and the second clamp assembly. The rod handling device also includes a biasing member coupled to the pivot rod, the biasing member being configured to urge the locking assembly toward the locked position.

20 Claims, 5 Drawing Sheets

U.S. PATENT DOCUMENTS

| | | | | |
|---|---|---|---|---|
| 5,277,463 | A | | 1/1994 | Singh et al. |
| 5,284,375 | A | | 2/1994 | Land, III |
| 5,350,209 | A | * | 9/1994 | Van Mullen et al. ..... 294/16 |
| 5,371,658 | A | * | 12/1994 | Christie ..... 362/109 |
| 6,119,558 | A | | 9/2000 | Foley, Jr. |
| 6,148,924 | A | | 11/2000 | Shafer |
| 6,543,555 | B2 | | 4/2003 | Casagrande |
| 6,634,443 | B1 | | 10/2003 | Paech et al. |
| 7,328,923 | B1 | | 2/2008 | Urdiales |
| 2007/0095524 | A1 | | 5/2007 | Lesko |

OTHER PUBLICATIONS

Sumner Ultra Clamp—Pipe Fit-Up Clamps, 2 pages [retrieved online] Jun. 3, 2009, Internet http://www.industrialladder.com/productsDetails.do?productID=3625&catergoryID=363.

International Search Report and Written Opinion dated Nov. 20, 2009 as issued in International Application No. PCT/US2009/046090 filed Jun. 3, 2009.

* cited by examiner

SPRING-LOADED ROD HANDLING DEVICE

RELATED APPLICATION

This application claims the benefit of U.S. Provisional Patent Application Ser. No. 61/058,518 filed Jun. 3, 2008 and entitled "Spring-Loaded Rod Handler Device", the disclosure of which is hereby incorporated by reference in its entirety.

BACKGROUND OF THE INVENTION

1. The Field of the Invention

The present invention relates to a device for handling elongate members and to rod handling devices in particular.

2. The Relevant Technology

Drill rods, such as kelly rods, core barrels, and the like, are often handled manually when transferring drill rods from a rod stack to a position on the feed frame of a conventional drill rig. Once on the feed frame, the drill rods are coupled to a drill string. Drill rods are also often handled manually when removing the drill rod from the drill string. The manual handling of the drill rods may be difficult due to the size of the drill rod. For example, drill rods are often long enough and of a diameter that makes it difficult to grip and handle the rods with hands alone.

Some devices have been provided that latch onto the drill rods that include clamps that engage the rods and handles that allow an easier grip for the operator. While such devices may allow for engagement of the drill rod, such devices may become unintentionally disengaged, resulting in an operator dropping the drill rod.

The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY OF THE INVENTION

A rod handling device is provided that includes a pivot rod, a first clamp assembly pivotingly coupled to the pivot rod, a second clamp assembly pivotingly coupled to the pivot rod, and at least one locking assembly configured to move between a locked position and an unlocked position. While in the locked position the locking assembly prevents rotation between the first clamp assembly and the second clamp assembly. The rod handling device also includes a biasing member coupled to the pivot rod. The biasing member is configured to urge the locking assembly toward the locked position.

The rod handling device may further include at least one locking assembly that includes a positive engagement feature and a negative engagement feature. In at least one example, the drill rod handling device is provided that biases the first and second clamp assemblies into locked engagement. The engagement features cooperate to lock the rod handling device in the closed position to thereby reduce or eliminate unintended rotation of the first and second clamp assemblies. Reducing unintended rotation of the first and second clamp assemblies may reduce the likelihood that the rod handling device could unintentionally release a drill rod.

Additional features and advantages of the invention will be set forth in the description which follows or may be learned by the practice of the invention. The features and advantages of the invention may be realized and obtained by means of the instruments and combinations particularly pointed out in the appended claims. These and other features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description will be rendered by reference to specific examples thereof which are illustrated in the appended drawings. It is appreciated that these drawings depict only examples and are therefore not to be considered limiting of its scope. Examples will be described and explained with additional specificity and detail through the use of the accompanying drawings in which.

DETAILED DESCRIPTION OF THE PREFERRED EMBODIMENTS

A rod handling device is provided herein that includes a locking assembly. According to at least one example, the rod handling device includes first and second clamp assemblies that rotate and/or translate relative to a pivot rod. For example, the first and second clamp assemblies may rotate between open and closed positions about the pivot rod. The rod handling device may be moved to the open position to receive a drill rod and/or to release an engaged drill rod. The drill rod handling device may be moved to the closed position to clamp a drill rod for handling.

The rod handling device further includes at least one locking assembly that, when locked, prevents rotation between the first and second clamp assemblies from the closed position. The rod handling device also includes a biasing member that biases the locking assembly toward a locked state. In at least one example, the locking assembly includes a positive engagement feature and a negative engagement feature. The engagement features cooperate to lock the rod handling device in the closed position to thereby reduce or eliminate unintended rotation of the first and second clamp assemblies. Reducing unintended rotation of the first and second clamp assemblies may reduce the likelihood that the rod handling device could unintentionally release a drill rod.

In the examples discussed below, a pin is described as the positive engagement feature and a socket is described as the negative engagement feature that receives the positive engagement feature. It will be appreciated that other types of locking assemblies may be provided that when engaged, lock the first and second assemblies together to prevent unintended rotation of the first and/or second clamp assemblies.

Such a configuration may be safer than non-locking systems as the device is locked into engagement during handling of a drill rod. Further, such a configuration may be relatively provide user-friendly, ergonomic and efficient designed. For example, safety may be improved due to a positive locking provided by the biasing member associated with the locking assembly. Efficiency may also be improved due to quick locking and unlocking of the locking assembly.

Figure 1:
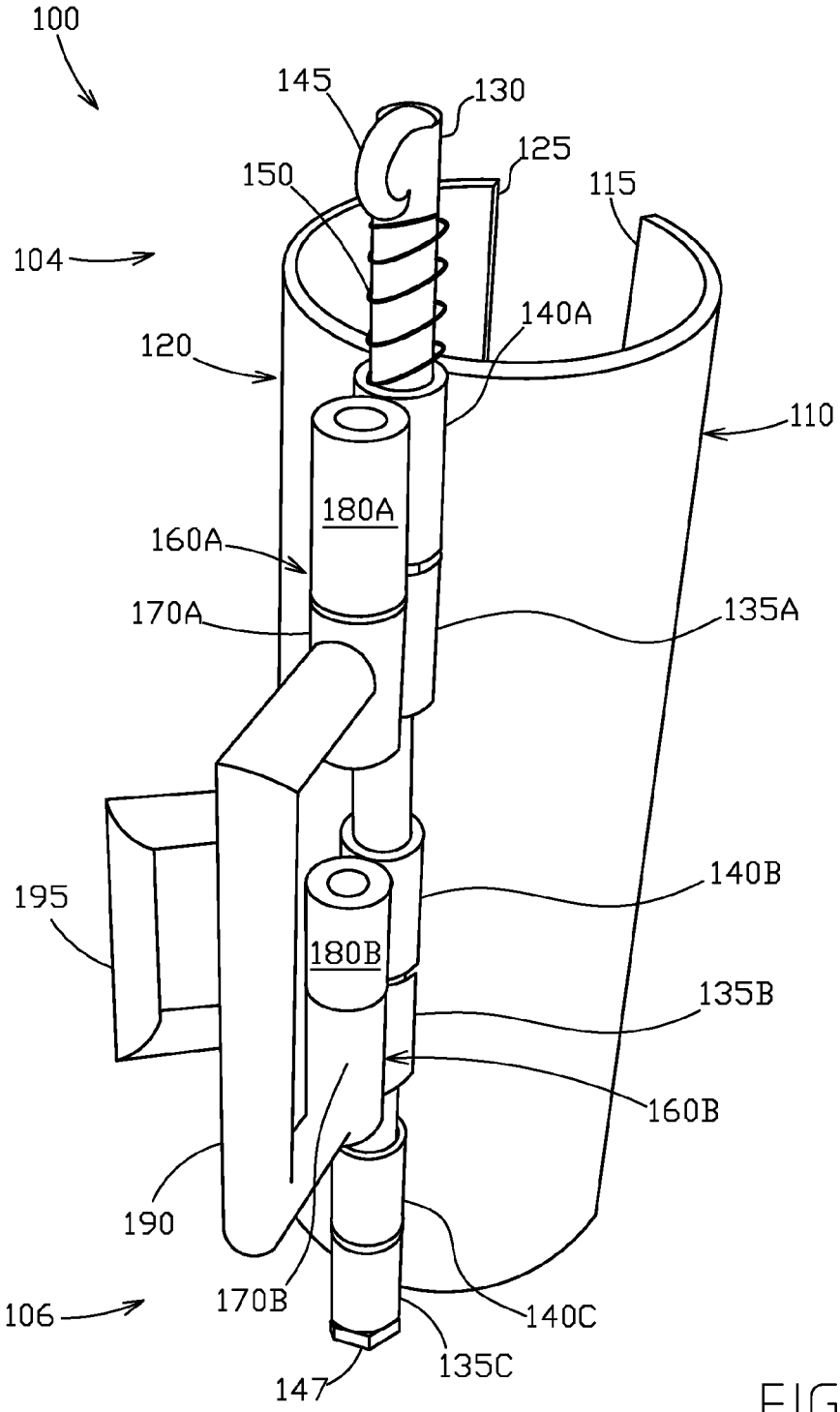
FIG. 1 illustrates a perspective view of a rod handling device in a closed, locked position according to one example.

FIG. 1 illustrates a perspective view of a rod handling device 100 in a closed, locked position according to one example. The rod handling device 100 generally includes a first end 104 and a second end 106. As illustrated in FIG. 1, the rod handling device 100 includes a first clamp assembly 110 and a second clamp assembly 120. The first clamp assembly 110 includes a first clamping portion 115 while the second clamp assembly 120 includes a second clamping portion 125. The first clamp assembly 110 and the second clamp assembly 120 are configured to rotate about a pivot rod 130 as the rod handling device 100 moves between an open position, and a closed, locked position.

As illustrated in FIG. 1, the pivot rod 130 passes through first pivot loops 135A, 135B, 135C, which are part of the first clamp assembly 110, and second pivot loops 140A, 140B, 140C, which are part of the second clamp assembly 120. The pivot rod 130 near the first end 104 may extend beyond second pivot loop 140A and end in a first anchor 145, such as a looped anchor. A biasing member 150, such as a spring, may be positioned between the first anchor 145 and second pivot loop 140A. In this position, the biasing member 150 may act to bias the first anchor 145 away from second pivot loop 140A and thus bias the first anchor 145 away from the second clamp assembly 120.

The pivot rod 130 near the second end 106 may be secured with a second anchor 147. Such a configuration couples movement of the pivot rod 130 to movement of the first clamp assembly 110. Accordingly, a biasing force that the biasing member 150 exerts on the first anchor 145 may be transmitted through the pivot rod 130 to the second anchor 147 and from the second anchor 147 to the first clamp assembly 110. Such a biasing force may thus bias the first clamp assembly 110 into engagement with the second clamp assembly 120, as will now be discussed in more detail.

With continuing reference to FIG. 1, the rod handling device 100 further includes one or more locking assemblies 160A, 160B operatively associated with the first clamp assembly 110 and the second clamp assembly 120 as well as with the pivot rod 130. Each of the locking assemblies 160A, 160B in turn includes pin assemblies 170A, 170B that engage sockets 180A, 180B. In at least one example, the pin assemblies 170A, 170B can be generally oriented parallel to the pivot rod 130, such the pin assemblies 170A, 170B and the pivot rod 130 are axially aligned. Similarly, the sockets 180A, 180B can be oriented, sized and configured to receive axially aligned pin assemblies 170A, 170B. The biasing force described above acts to urge the pin assemblies 170A, 170B into engagement with sockets 180A, 180B.

Figure 2:
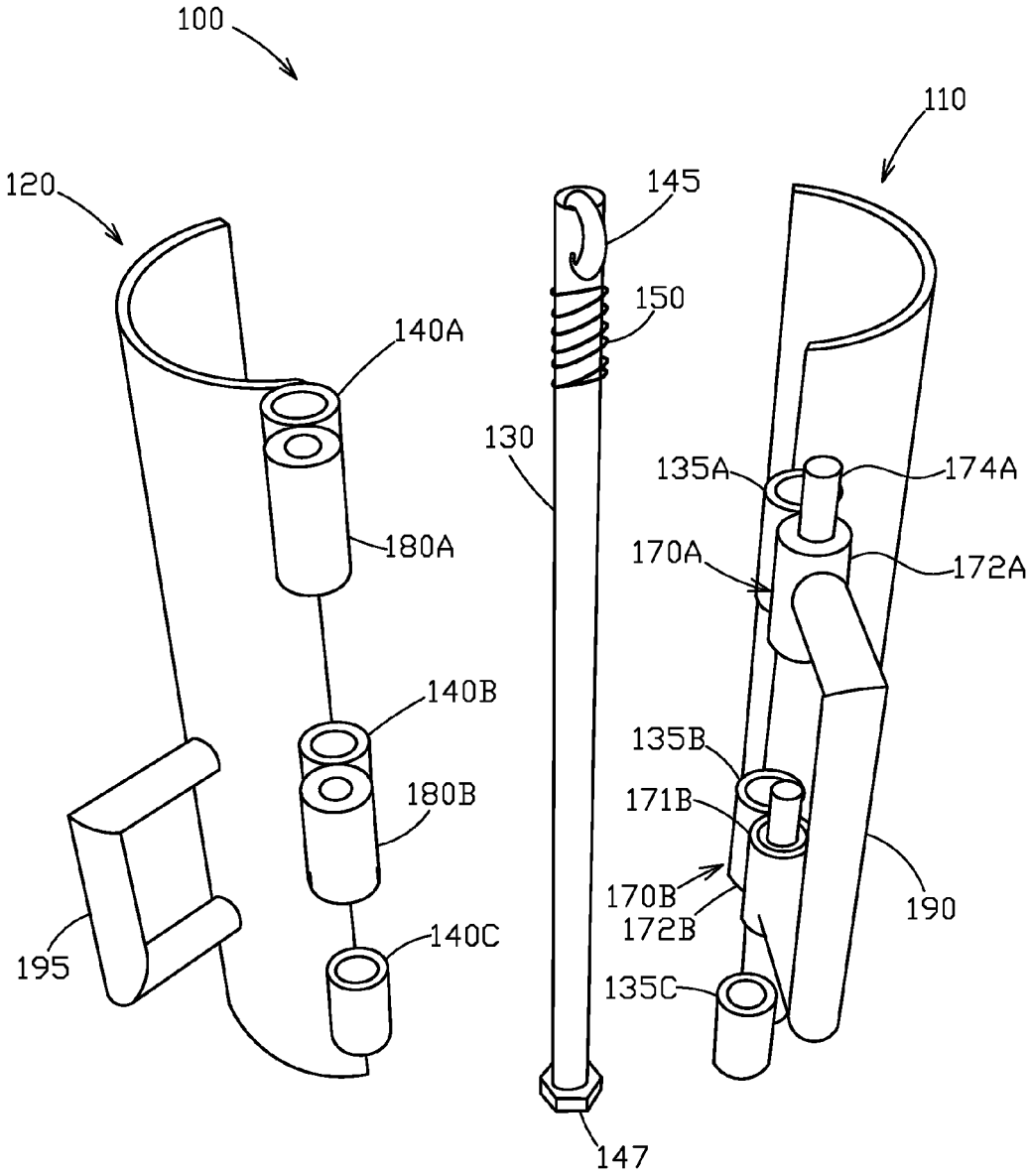
FIG. 2 illustrated an exploded view of the rod handling device of FIG. 1.

FIG. 2 illustrates an exploded view of the rod handling device 100. In the illustrated example, pin assemblies 170A, 170B each include bases 172A, 172B and pins 174A, 174B secured to the bases 172A, 172B while the sockets 180A, 180B include recesses defined therein that at least partially receive the pins 174A, 174B when the locking assemblies 160A, 160B (FIG. 1) are in a locked position.

In at least one example, the pin assemblies 170A, 170B are secured to first pivot loops 135A, 135B respectively while the sockets 180A, 180B are secured to second pivot loops 140A, 140B respectively. Such a configuration may cause translation of the first clamp assembly 110 along the pivot rod 130 relative to the second clamp assembly 120 to result in similar translation of the pin assemblies 170A, 170B relative to the sockets 180A, 180B. Such translation may thus move the pins 174A, 174B into and out of engagement with the sockets 180A, 180B to unlock and lock the rod handling device 100.

Further, as illustrated in FIGS. 1 and 2, the rod handling device 100 includes a first handle 190 coupled to the first clamp assembly 110 and a second handle 195 coupled to the second clamp assembly 120. In the illustrated example, the first handle 190 is secured to pin assemblies 170A, 170B while the second handle 195 is secured to the second clamping portion 125. The handles 190, 195 provide convenient grips to allow a user to manipulate the rod handling device 100 between a closed, locked position shown in FIG. 1, a closed, unlocked position shown in FIG. 3 and the open position shown in FIG. 4.

The handles 190, 195 may further provide grip for an operator to manually handle a drill rod from a rod stack to a drill head and vice versa. As introduced, in the closed position, the biasing member 150 helps maintain the rod handling device 100 in a closed, locked position. Such a configuration may reduce the potential that the rod handling device 100 will become disengaged from the drill rod, thereby increasing the security of the operator in manually handling a drill rod. In order to move the rod handling device 100 from a closed, locked position to an open position, the rod handling device 100 illustrated is first moved to a closed, unlocked position.

Figure 3:
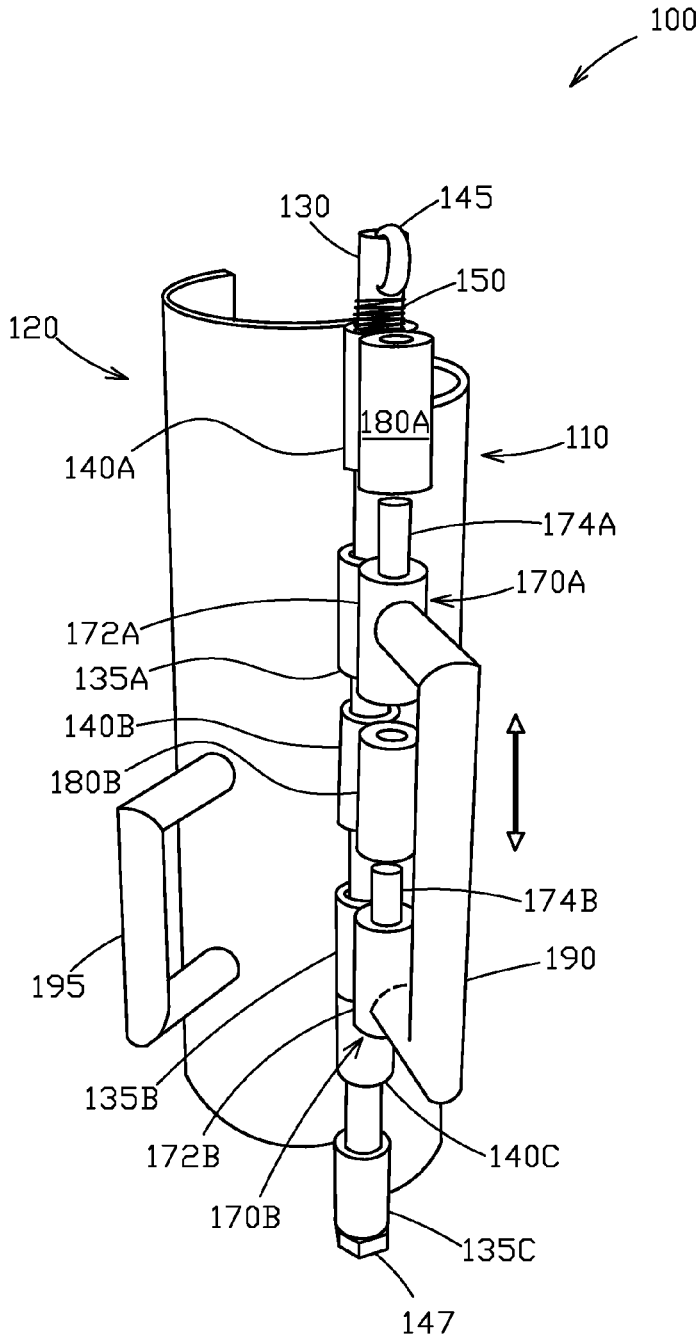
FIG. 3 illustrates a perspective view of the rod handling device in a closed, unlocked position.

FIG. 3 illustrates the rod handling device 100 in a closed, unlocked position. In at least one example, the rod handling device 100 may be moved to such a position by moving first handle 190 relative to the second handle 195 along the pivot rod 130 in the direction shown by the arrow. As previously introduced, the first handle 190 is secured to the pin assemblies 170A, 170B which are in turn secured to the first pivot loops 135A, 135B. The first pivot loops 135A, 135B are secured to the first clamping portion 115, to which first pivot loop 135C is secured.

As previously discussed, the second anchor 147 secures the pivot rod 130 to the first pivot loop 135C and thus to the first clamp assembly 110. Accordingly, as the first handle 190 is moved in the direction indicated by the arrow, each of the components discussed above also move in the direction indicated, thereby displacing the first clamping portion 115 relative to the second clamping portion 125 as shown. This movement also results in movement of the pin assemblies 170A, 170B relative to the sockets 180A, 180B to thereby draw the pins 174A, 174B from engagement with the sockets 180A, 180B. As the pivot rod 130 is drawn in the direction indicated, the biasing member 130 is compressed between first anchor 145 and second pivot loop 140A, exerting a biasing force as described above.

With the pins 174A, 174B disengaged from the sockets 180A, 180B, the rod handling device 100 may then be moved to the open position. As illustrated in FIG. 3, in the closed position the handles 190, 195 are separated. The handles 190, 195 may then be moved toward the positions illustrated in FIG. 4.

Figure 4:
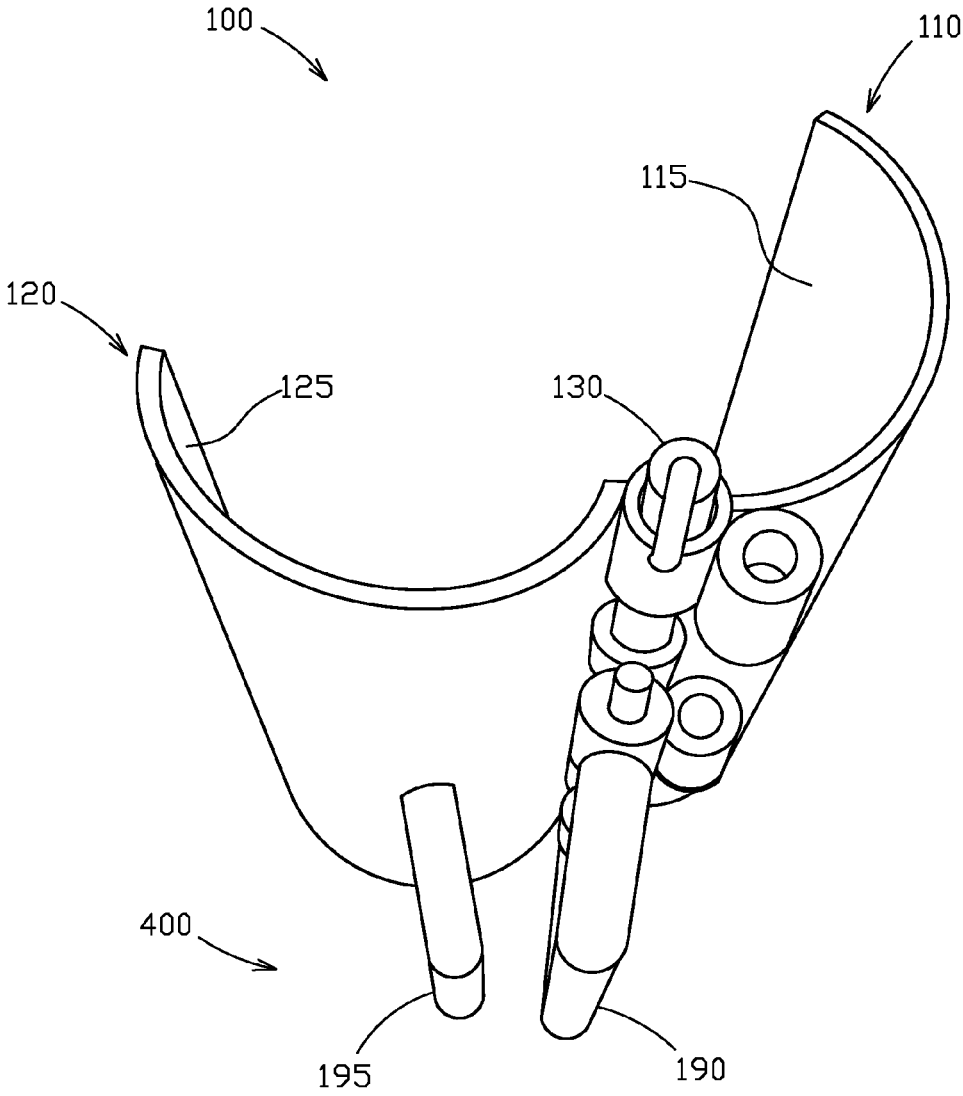
FIG. 4 illustrates a perspective view of the rod handling device in an open position.

FIG. 4 illustrates a perspective view of the rod handling device of FIG. 4 in which the gripping arms are moved toward an open position. As the handles 190, 195 move toward the open position, the first clamp assembly 110 and the second clamp assembly 120 pivot about the pivot rod 130 to move the clamping portions 115, 125 apart from each. As previously introduced, the rod handling device 100 may be moved to the open position to release a drill rod from engagement with the rod handling device 100 or to introduce a drill rod to the rod handling device 100.

Accordingly, opening the rod handling device 100 may include moving the first clamp assembly 110 along the pivot rod 130 relative to the second clamp assembly 120 to the closed, unlocked position shown in FIG. 3 and then rotating the first and/or second clamp assemblies 110, 120 about the pivot rod 130 to move the clamping portions 115, 125 to the open position illustrated in FIG. 4.

Similarly, closing the rod handling device 100 may include rotating the first and/or second clamp assemblies 110, 120 from the position shown in FIG. 4 to the position shown in FIG. 3, and then moving the first clamp assembly 110 along the pivot rod 130 into engagement with the position shown in FIG. 1. The biasing member 150 may act to facilitate the movement of the first clamp assembly 110 from the position shown in FIG. 3 to the position shown in FIG. 1. While thus positioned, engagement between the pins 174A, 174B and the sockets 180A, 180B may lock the first and second clamp assemblies 110, 120 and thereby prevent unintended rotation between the first and second clamp assemblies 110, 120.

While engaged, the rod handling device 100 engages the drill rod and provides grips for an operator to manually handle a rod. The clamping portions 115, 125 may have any shape and/or size for engaging different types and sizes of drill rods. For example, the clamping portions 115, 125 may have generally arcuate interior surfaces. Further, each or both of the arcuate interior surfaces may have a radius of curvature that correspond closely to drill rod size. Such drill rod sizes may include drill rods of any size, such as drill rods having a diameter of between about 0.5 inches and about 60 inches.

Accordingly, a rod handling device has been provided that includes at least one locking assembly that includes a positive engagement feature and a negative engagement feature. In at least one example, the drill rod handling device is provided that biases the first and second clamp assemblies into locked engagement. The engagement features cooperate to lock the rod handling device in the closed position to thereby reduce or eliminate unintended rotation of the first and second clamp assemblies. Reducing unintended rotation of the first and second clamp assemblies may reduce the likelihood that the rod handling device could unintentionally release a drill rod. While one configuration has been shown and described, it will be appreciated that other configurations are possible.

Figure 5:
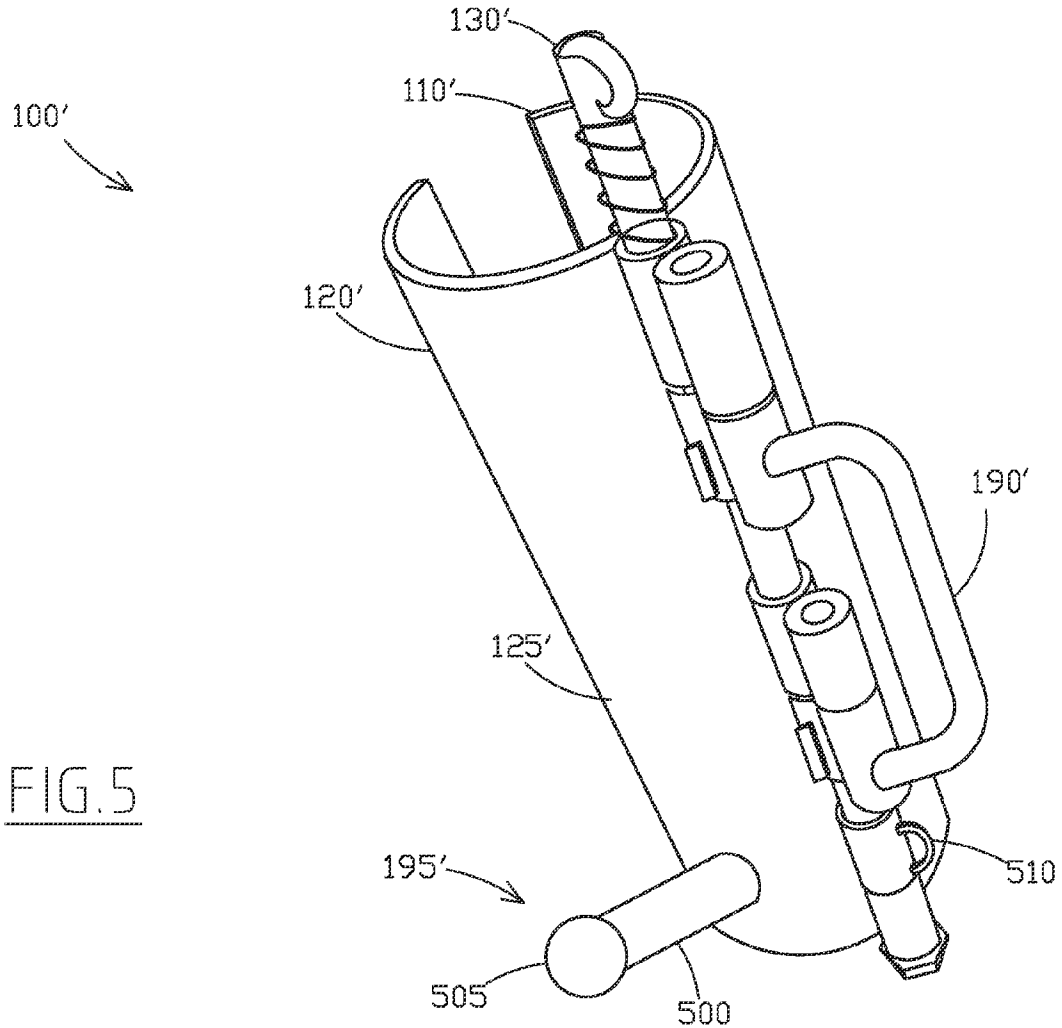
FIG. 5 illustrates a perspective view of a rod handling device in a closed, locked position according to one example

For example, FIG. 5 illustrates a rod handling device 100' that includes a first clamp assembly 110' and a second clamp assembly 120' that are configured to pivot relative to a pivot rod 130'. Further, the first clamp assembly 110' is configured to translate axially along the pivot rod 130' to unlock the first clamp assembly 110' from the second clamp assembly 120' in a similar manner to the locking and unlocking configuration described above.

The first clamp assembly 110' includes a handle 190' configured similarly to the handle 190 described above with reference to the rod handler 100 shown in FIGS. 1-4. The second clamp assembly 120' shown in FIG. 5 includes handle 195' that includes a grip portion 500 that extends from a second clamping portion 125' of the second clamp assembly 120'. The handle 195' can further include a bulbed portion 505 associated with the end of the grip portion 500. Such a configuration can help reduce the possibility that an operator's hand will slip from the handle 190' during operation.

The rod handling device 100' can be operated by gripping the 190' and moving the handle 190' axially along the pivot rod 130' to move the first clamp assembly 110' away from the second clamp assembly 120' and thereby unlock the first and second clamp assemblies 110', 120'. Thereafter, the first clamp assembly 110' and/or the second clamp assembly 120' can be pivoted about the pivot rod 130' to open the rod handling device 100'. The process can be reversed to close the rod handling device 100'. Accordingly, a spring-loaded rod handling device can have various configurations.

For example, while multiple pivot loops are shown, it will be appreciated that each of the clamp assemblies may include any number of pivot loops and that the number of pivot loops associated with the first clamp assembly 110 may be less than, equal to, or greater than the number of pivot loops associated with the second clamp assembly 120.

Further, while handles are discussed as being utilized for manual handling, it will be appreciated that first and second clamp assemblies may also be part of an automated rod handling system. In such an example, actuators, such as hydraulic or other actuators may be used to move first and second clamp assemblies between the positions described herein to handle a rod.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A rod handling device, comprising:

a pivot rod;

a first clamp assembly pivotingly coupled to the pivot rod;

a second clamp assembly pivotingly coupled to the pivot rod;

at least one locking assembly configured to move between a locked position and an unlocked position, wherein in the locked position the locking assembly prevents rotation between the first clamp assembly and the second clamp assembly; and a biasing member coupled to the pivot rod, the biasing member being configured to urge the locking assembly toward the locked position.

2. The rod handling device of claim 1, wherein the locking assembly includes a positive engagement feature associated with the first clamp assembly and a negative engagement feature associated with the second clamp assembly, wherein engagement between the positive engagement feature and the negative engagement feature locks the rod handling device in a closed position.

3. The rod clamp device of claim 2, wherein the biasing member is configured to exert a biasing force on at least one of the first clamp assembly and the second clamp assembly to urge engagement between the positive engagement feature and the negative engagement feature.

4. The rod handling device of claim 3, wherein at least one of the first clamp assembly and the second clamp assembly are configured to translate along the pivot rod.

5. The rod handling device of claim 4, wherein translation of at least one of the first clamp assembly and the second clamp assembly acts counter to the biasing force exerted by the biasing member to thereby release engagement between the positive engagement feature and the negative engagement feature to allow rotation between the first clamp assembly and the second clamp assembly.

6. The rod handling device of claim 2, wherein, the positive engagement feature includes at least one pin.

7. The rod handling device of claim 6, wherein the pin is axially aligned relative to the pivot rod.

8. The rod handling device 7, wherein the positive engagement feature includes a plurality of pins axially aligned parallel to the pivot rod.

9. A rod handling device, comprising:

a pivot rod;

a first clamping assembly having a first clamp portion, a positive engagement feature operatively associated with the first clamp portion, and a first handle operatively associated with the first clamp portion;

a second clamping assembly having a second clamp portion, a negative engagement feature operatively associated with the second clamp portion and configured to receive at least a portion of the positive engagement feature, and a second handle operatively associated with the second clamp portion; and a biasing member operatively associated with the pivot rod, the biasing member being configured to exert a biasing force in a direction generally parallel to a central axis of the pivot rod to move the positive engagement feature and the negative engagement feature axially toward each other, wherein axial translation between the negative engagement feature and the positive engagement feature moves the first clamping assembly and the second clamping assembly in and out of locking engagement.

10. The rod handling device of claim 9, wherein the first clamping portion and the second clamping portion are operatively associated with the pivot rod in such a manner a manner as to allow at least one of the first clamping portion or the second clamping portion to pivot about the pivot rod to move the rod handling device between an open position and a closed position.

11. The rod handling device of claim 10, wherein the positive engagement feature includes at least one pin having a central axis that is generally parallel to the central axis of the pivot rod.

12. The rod handling device of claim 9, wherein the positive engagement feature includes at least one pin.

13. The rod handling device of claim 9, wherein opposing anchors are associated with opposing ends of the pivot rod and wherein the biasing member is positioned between one of the opposing anchors and one of the first clamping portion and the second clamping portion.

14. The rod handling device of claim 9, wherein the second handle includes a grip portion extending away from the second clamping portion and a bulbed portion associated with the grip portion.

15. The rod handling device of claim 9, wherein at least one of the first clamping portion and the second clamping portion has an inner surface with a shape complementary to a drill rod.

16. A method of handling a drill rod, comprising:

providing a rod handling device having a pivot rod, a first clamp assembly pivotingly coupled to the pivot rod, a second clamp assembly pivotingly coupled to the pivot rod, and and a biasing member coupled to the pivot rod, the biasing member being configured to urge a locking assembly toward a locked position; and selectively engaging a drill rod by moving the locking assembly between a locked position and an unlocked position by moving at least one of the first clamp assembly or the second clamp assembly in a direction parallel to an axis of the pivot rod, wherein in the locked position the locking assembly prevents rotation between the first clamp assembly and the second clamp assembly and moving the first clamp assembly and the second clamp assembly between an open position and a closed position by pivoting at least one of the first clamp assembly or the second clamp assembly about the pivot rod.

17. The method of claim 16, where moving the locking assembly between a locked position and an unlocked position includes moving a pin between engagement and disengagement with a socket by moving the pin parallel to the axis of the pivot rod.

18. The method of claim 15, wherein moving the pin between engagement and disengagement with a socket by moving the pin parallel to the axis of the pivot rod includes applying forces to a first handle associated with the first clamp assembly and a second handle associated with the second clamp assembly in opposing directions parallel to the axis of the pivot rod.

19. The method of claim 18, wherein moving first clamp assembly and the second clamp assembly between the open and closed positions includes applying pivoting forces to at least one of the first handle and the second handle.

20. The method of claim 18, wherein moving first clamp assembly and the second clamp assembly between the locked and unlocked position includes moving the clamp assemblies between a locked, closed position and an unlocked, closed position.

* * * * *